US006203743B1

(12) United States Patent
Reese

(10) Patent No.: US 6,203,743 B1
(45) Date of Patent: Mar. 20, 2001

(54) HEAT SETTING A TOW OF SYNTHETIC FIBERS USING HIGH PRESSURE DEWATERING NIP

(76) Inventor: Glen Patrick Reese, 4601 Carmel Vista Ln., Charlotte, NC (US) 28226

( * ) Notice: Subject to any disclaimer, the term of this patent is extended or adjusted under 35 U.S.C. 154(b) by 0 days.

(21) Appl. No.: 09/410,704

(22) Filed: Oct. 1, 1999

(51) Int. Cl.[7] ..... D01D 5/16; D01D 10/02; D01D 10/06; D02J 13/00

(52) U.S. Cl. ..... 264/235.6; 28/220; 28/240; 264/289.6; 264/290.5; 264/346; 425/363; 425/445

(58) Field of Search ..... 264/210.8, 235.6, 264/289.6, 290.5, 346; 425/363, 445; 28/220, 240

(56) References Cited

U.S. PATENT DOCUMENTS

| | | | | |
|---|---|---|---|---|
| 3,786,574 | * | 1/1974 | Finley et al. | 28/240 X |
| 3,968,571 | | 7/1976 | Oschatz et al. . | |
| 4,112,668 | | 9/1978 | Spiller . | |
| 4,197,622 | | 4/1980 | Williamson . | |
| 5,679,300 | | 10/1997 | Lorenz et al. . | |

* cited by examiner

*Primary Examiner*—Leo B. Tentoni
(74) *Attorney, Agent, or Firm*—Gregory N. Clements

(57) ABSTRACT

An apparatus and method for heat setting a traveling tow of synthetic filaments utilizing a high pressure dewatering nip roll mechanism to remove moisture from the tow prior to heat setting. The high pressure dewatering nip roll mechanism includes a pair of nip rollers exerting a pressure of between about 500 and 2000 pounds per linear inch of transverse nip contact on the traveling tow prior to the tow entering a heat setting apparatus such as a calender apparatus. Moisture content of the traveling tow is reduced to less than 10% moisture by weight and preferably less than 5%. Reducing the moisture content of the tow prior to heat setting reduces the energy required to heat set the tow and, contrary to the prevailing wisdom in the art, does not damage the unheat set filaments of the tow. A process of treating a traveling tow of synthetic filaments is also disclosed which includes the steps of drawing the tow to combine molecule chains and orient the molecules substantially along the filament axis, subjecting the tow to moisture during the drawing step, dewatering the tow using a pair of high pressure dewatering nip rolls and then heat setting the tow to crystallize a majority of the molecules in the synthetic tow material, thereby producing a strong tow while minimizing the amount of energy required to heat set the tow.

19 Claims, 6 Drawing Sheets

HEAT SETTING A TOW OF SYNTHETIC FIBERS USING HIGH PRESSURE DEWATERING NIP

BACKGROUND OF THE INVENTION

1. Technical Field

The present invention relates generally to the production of synthetic polymer fibers and more specifically to an apparatus and method for more efficiently heat setting the polymer fibers.

2. Background Information

Synthetic fibers for use in the manufacture of synthetic yarns are produced by a process called spinning, wherein polymeric material is extruded through small holes of a device called a spinneret to form filaments of semi-solid polymer that are subsequently solidified to form an endless polymeric filament. For example, polyethylene terephthalate (PET) fibers, a type of polyester, is formed by a process called "melt spinning" in which melted polymeric material is extruded and then solidified by cooling. Once produced, the synthetic filaments are gathered and transported longitudinally in a lengthwise co-extensive bundle commonly referred to as a "tow." Typically, after formation synthetic filaments are then drawn or stretched, heat set and crimped before being cut and baled.

A typical drawing process involves transporting multiple tows in a side-by-side relation through drawstands having a series of rollers operating at progressively greater driven speeds to exert a lengthwise stretching force on the travelling tows and their individual filaments. Drawing exerts a lengthwise force on the filaments that pulls molecular chains together and orients the chains along the filament axis. Typically, the drawing process is done in one or more steps and is often done at an elevated temperature, but usually less than approximately 100° C. Drawing creates a stronger yam than would be made from undrawn synthetic filaments.

After drawing, synthetic filaments are then subjected to a heat setting process in order to stabilize the stretched fibers by crystallization of the polymer molecules under controlled tension. Effective heat setting of synthetic polymer filaments requires heating the filaments to a temperature of over 150° C. and often to a temperature of approximately 200° C. A calendering apparatus having a series of heated rolls about which the tow travels peripherally in a sinuous path is usually used to heat set synthetic polymer tows. But polymeric materials in general, and PET in particular, exhibit low thermal conductivity. Furthermore, the interstitial spaces between individual filaments in a tow comprising collectively numerous individual filaments exacerbate the difficulty of transferring heat throughout the thickness of a tow. Because calender rolls rely on conduction to transfer heat from the surface of the roll through the tow, and because only a portion of the tow filaments actually contact the calender rolls, heat penetrates very slowly through the thickness of the tow.

In order to promote more rapid heat transfer through a tow, it is known to construct calendering apparatus with sufficiently long cantilevered rolls to permit the spreading of the individual filaments of the tow in the form of a ribbon or band along the length of the roll. In fact, the length of a typical calender roll can exceed 1.5 meters, thus necessitating a very large calendering apparatus structure with mechanical bearings sufficiently massive to support the rolls and to resist the bending moments and deflective forces imposed by the tows of the size and density conventionally being processed.

After being heat set, synthetic polymeric filaments are usually cooled and transported through a crimper, such as a so-called stuffer box, to impart texture and bulk to the individual filaments before further processing such as drying, cutting, and baling. Because conventional tow crimping equipment requires a thicker, denser tow than the thinly spread towband for which the conventional calendering apparatus is intended, a disadvantage of the use of such calenders with long massive rolls is that an additional unit of equipment must be interposed between the calender structure and the crimper to condense and reform the tow into a thickness suitable for delivery to the crimper. Often, the crimping process is accomplished at an elevated temperature and typically around approximately 100° C.

Various water-based sprays and aqueous emulsions are used throughout the drawing, heat setting and crimping processes described above. Aqueous emulsions may be used to facilitate such characteristics as tow cohesion, lubrication, and heat transfer and various water and steam sprays may be use to adjust the temperature of the tow. For example, a typical drawing process might include a pretension stand followed by two drawstands arranged such that the synthetic filaments travel through a predraw bath of water-based emulsion following the pretension stand; through a draw chest of warm water spray between the two drawstands; and through a second draw chest of steam spray after the second drawstand.

The conventional practice of processing synthetic fibers in a wet state before heat setting is problematic because the tow retains moisture and this moisture must be evaporated from the tow before the synthetic filaments can be effectively heat set. A saturated polyester tow can easily contain approximately 25% moisture by weight as it enters the heat setting calendering apparatus. This moisture, much of which is in the interstitial area between filaments in the tow, must be evaporated before it is possible to raise the filament temperature to the heat setting point. Notwithstanding the practice of spreading the filaments into bands contacting the heated calender rolls, a tremendous amount of energy is still required to evaporate moisture in the towband before heat setting can begin. In fact, it is estimated that approximately two thirds of the energy used by conventional calendering apparatus is used just to evaporate moisture within the towbands; only one third of the energy used in conventional calenders is actually used for elevating the filament temperature for heat setting purposes.

Not only does this expenditure of energy translate directly into increased cost, but the inefficiency of current calendering apparatus also limits production capability by limiting either the thickness of the towbands or the speed of tow travel to that which can be effectively heat set by a given calendering apparatus. Currently, the only way to achieve effective heat setting of higher density tows is to either increase the energy use by a calendering apparatus or increase the travel time of the tow through the calender apparatus.

While it is known to provide a squeeze roll at the entrance of a calendering apparatus to partially dewater the traveling towbands entering the calender, it is currently thought in the art that care must be used when subjecting synthetic filaments to pressure before the filaments are heat set in order to avoid damaging the filaments. For this reason, conventional squeeze rolls acting on synthetic filaments before heat setting are limited to lower nip pressures and made from resilient nip roll materials such as rubber in order to minimize the possibility of filament damage. For example, U.S. Pat. No. 4,112,668 to Spiller discloses a method for production of polyester staple yarn in which a tow is passed between a pair of squeeze rolls before being heat set and U.S. Pat. No. 3,968,571 to Oschatz et al. discloses a process of removing liquid from an absorbent substrate by passing the substrate through a pair of nip rollers, the surface of at least one of which is comprised of a sponge material having capillary pores. The nip roll arrangement disclosed in the Spiller patent is said to reduce moisture content of the tow below about 15%. The pressure at the nip between the rollers disclosed in the Oschatz patent is less than one kilogram per centimeter of roller length.

It is also known in the art that a high pressure nip roll mechanism may be used to remove moisture from a tow subsequent to heat setting of the tow filaments. In fact, high pressure nip rolls are conventionally used just prior to the crimping process to remove moisture and finish solvent applied to the tow before crimping. U.S. Pat. No. 4,197,622 to Williamson, for example, discloses a wet tow crimping process in which an advancing tow of fibers is uniformly compressed under a nip pressure of 600–1,000 pounds per inch to exude solvent-containing water from the tow just prior to crimping and U.S. Pat. No. 5,679,300 to Lorenz et al. discloses a method of treating a tow of melt-spun filaments in which the tow is passed through a pair of squeeze rolls after being heat set to reduce the fiber finish pickup to 0.7–7% by weight of the tow. As previously mentioned, however, it is generally thought in the art that such high nip pressures cannot be used prior to heat setting the filaments without sustaining damage to the filaments which would destroy them or at least render them unusable.

As shown by the above discussion, there exists a need in the art to effectively heat set synthetic tow filaments without expending a substantial amount of energy removing moisture from the tow before heat setting. This would allow less costly processing of synthetic filament tows and facilitate the processing of higher speed and more dense tows than is currently possible.

BRIEF SUMMARY OF THE INVENTION

The present invention addresses the problems encountered when using conventional calendering apparatus to heat set a tow of synthetic filaments by providing a synthetic tow processing apparatus and method which depart from and indeed run directly contrary to the conventional wisdom of the art through the use of a high pressure dewatering nip roll station located between a drawing station and in advance of a heat setting station to exert pressures on the tow of at least about 500 pounds of force per linear inch of axial nip roll contact. Contrary to the prevailing knowledge in the art, it has been unexpectantly discovered that application of such high nip pressures prior to heat setting does not damage the synthetic filaments of the tow, and even more unexpectantly, it has been further discovered that this result is so regardless of the uniformity of tow presentation to the nip.

The present invention uses calender rolls heated to approximately between 150 and 200° C. to heat set the tow filaments. Moisture content of the tow leaving the nip roll mechanism is reduced to less than 10% and preferably to less than 5% by weight before introduction of the tow to the calender. Because moisture is removed by mechanical means prior to the tow entering the heat setting apparatus, it is possible to effect heat setting of synthetic filament tows using the present invention with substantially less energy being expended during the heat setting process.

The present invention also includes a method of treating a tow of synthetic filaments that includes the sequential steps of drawing the tow to combine the molecule chains and orient them along the filament axis, dewatering the tow using a pair of nip rolls exerting a pressure of between 500 and 2,000 pounds per linear inch of tow contact, and then heat setting the tow to crystallize a majority of the molecules in the synthetic tow material. The process of the present invention may also include heat setting the tow using calender rolls heated to approximately 150 to 200° C. Advantageously, the present invention allows for the reduction of moisture from a tow of synthetic filaments to a level of less than about 5% moisture before entering the heat setting apparatus.

These and other advantages of the present invention will become apparent upon reading the following detailed description and appended claims, and upon reference to the accompanying drawings.

BRIEF DESCRIPTION OF THE DRAWINGS

For a more complete understanding of this invention reference should now be had to the embodiments illustrated in greater detail in the accompanying drawings and described below. In the drawings, which are not necessarily to scale.

DETAILED DESCRIPTION OF THE INVENTION

The present invention will now be described fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. It will be understood that all alternatives, modifications, and equivalents are intended be included within the spirit and scope of the invention as defined by the appended claims.

Figure 1:
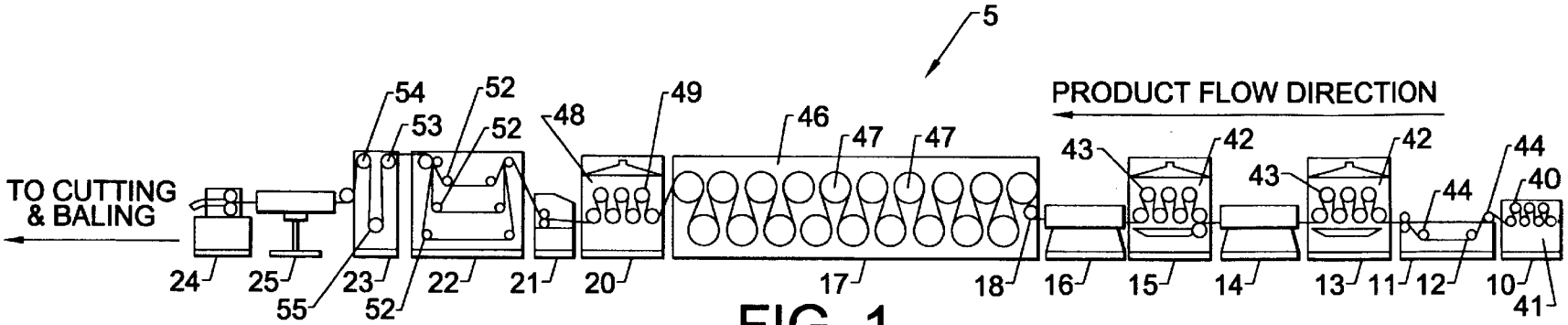
FIG. 1. (PRIOR ART)
FIG. 1 is a schematic diagram illustrating a conventional system for drawing, heat setting, and crimping a tow of continuous synthetic filaments.

Turning now to the accompanying drawings and initially to FIG. 1, a conventional PET processing line for drawing, heat setting, and crimping filamentary tow is depicted schematically and indicated in its totality at 5. The processing line basically comprises a series of machine units arranged in alignment with one another for transporting a tow or tows sequentially from one machine unit to the next.

Tow from storage cans or another suitable source of supply is initially delivered to a pretensioning stand 10 having a series of driven cylindrical rolls 40 arranged alternatingly along upper and lower horizontal lines along the lengthwise extent of a central frame 41 for travel of the tow 12 in a serpentine path in engagement with the periphery of each upper and lower roll in sequence, whereby the multiple rolls 40 collectively establish an initial tensioning point in the processing line 5 preliminary to downstream drawing of the tow 12.

Two drawstands 13, 15 are positioned downstream from the pretensioning stand 10 and spaced from one another. Each drawstand 13, 15 similarly comprising a central upstanding frame 42 from which multiple cylindrical cantilevered rolls outwardly extend to alternatingly along upper and lower horizontal lines for travel of the tow 12 in like manner along a sinuous path peripherally about each roll 43 in sequence, whereby the two drawstands 13, 15 establishing additional tensioning points along the processing line 5.

A vat 11 containing a predrawing bath, which is preferably a water-based emulsion, is disposed between the pretensioning stand 10 and the first drawstand 13 for application to the tow 12 before entering the first drawstand. A series of rolls 44 are mounted at the entrance and exit ends of the vat 11 and also within the vat 11 below the bath level to direct the travel of the tow 12 for immersion in the bath. A first draw chest 14 basically constructed as an enclosed tunnel containing an atmosphere of warm water sprays is disposed between the two drawstands 13, 15. A second draw chest 16 is disposed at the downstream side of the second drawstand 15 but operates at a higher temperature than the first draw chest 14, applying steam to the tow 12 while traveling through the tunnel of the chest.

A calendering apparatus 17 is located immediately downstream of the second draw chest 16 and basically comprises a relatively massive structure having a large central frame 46 from which a plurality of large-diameter calender rolls 47 are cantilevered outwardly alternatingly along upper and lower horizontal lines for serpentine travel of the tow 12 peripherentially around the rolls 47 in sequence, in like manner to that previously described with respect to the pretensioning stand 10 and the drawstands 13, 15. The cylindrical periphery of each calender roll 47 is heated from the interior of the roll by any suitable conventional means to a sufficient temperature (selected according to the physical characteristics of the tow, its traveling speed, and other known variables) to heat set the individual filaments 33 (FIG. 3A) in the tow 12, the serpentine travel of the tow accomplishing heat application to both sides of the tow as it travels from one calender roll 47 to the next.

Immediately downstream of the calendering apparatus 17, a quench stand 20, similarly comprising a frame 48 having sequential cantilevered rolls 49 extending outwardly therefrom, is provided for cooling the tow 12 sufficiently below the heat setting temperature established by the calendering apparatus 17 to control shrinkage of the tow 12. The tow 12 travels from the quench stand 20 through a spray stand 21 in which a spray of a suitable finishing composition adapted to enhance the subsequent crimping of the filaments 33 and the tow 12 is applied to the traveling tow.

The tow 12 in a conventional commercial processing line will typically comprise filaments 33 totaling up to approximately five million denier. In order to optimize the uniform application of drawing forces and heating to all constituent filaments within the tow 12, the filaments are spread from the normal rope-like bundled configuration of the tow 12 into a thin substantially flattened ribbon-like or band-like configuration illustrated in FIG. 3A while traveling about the various rolls of the upstream machine units. However, conventional crimping apparatus are unsuitable for handling such a flattened thin ribbon-like towband. Therefore, preparatory to a final step of crimping the tow 12, the filaments 33 must be condensed into a thicker band, which is accomplished by a so-called stacker frame 22 situated immediately downstream of the spray stand 21. The stacker frame 22 comprises a plurality of rolls 52 arranged substantially as shown in FIG. 1 to define separate travel paths by which divided portions of the tow 12 can be directed to travel along independent paths. The rolls 52 that define the different tow travel paths are oriented in known manner out of parallel relation with the other rolls 52 to direct the divided portions of the tow 12 to a common point along the exit roll of the stacker frame 22 at which the divided portions of the tow 12 are reassembled atop one another to form a thicker towband.

The tow 12 is delivered from the stacker frame 22 into a so-called dancer frame 23 of known construction, basically having stationary entrance and exit rolls 53, 54 between which a third roll 55 is movable to take up tension fluctuations in the tow 12 thereby ensuring that the tow is delivered downstream at a substantially constant tension.

The tow 12 is transported from the dancer frame 23 through a steam atmosphere in a tunnel like steam chest 25 and therefrom is delivered into a crimper 24, which may be of any known construction to impart crimp or texture to the tow 12, e.g., a so-called stuffer box, a gear crimping unit, or other suitable alternative devices. Downstream of the crimper 24, the crimped or otherwise textured tow 12 is further dried, cut to staple lengths, and the staple filaments collected in bale form for delivery to a conventional spinning operation for manufacture of spun yarn.

As described above, the PET processing line 5 represents the most effective structure and methodology under the current state of the art for drawing, heat setting and texturing of continuous synthetic filament. The overall structure of the conventional processing line, however, is quite massive and very expensive. This is due in large part to the size required of the calender apparatus 17, particularly the diametric dimension of the calender rolls 47 and the structural requirement of the frame 46 and the bearing structures therein to support the calender rolls 47 against deflection, in order to satisfactorily apply heat uniformly throughout the entire tow 12 to all constituent filaments 33 thereof. Even utilizing the technique of spreading the tow 12 into the form of a relatively thin ribbon-like towband, the calender apparatus 17 must still be quite massive, and the difficulty in uniformly imparting a sufficient heat setting temperature throughout the towband imposes limitations on the traveling speed of which the tow 12 of a given collective denier can be processed.

Because the tow 12 is processed in a wet condition prior to heat setting, the calender apparatus 17 and specifically the calender rolls 47 must first provide enough energy to evaporate moisture from the towband before energy can be used to raise the temperature of the filaments 33 in the tow 12 to an appropriate heat setting temperature. But a tow of synthetic filaments in general, and a tow of polyester filaments in particular, is a relatively poor heat conductor. Accordingly, a tremendous amount of energy is used by the calender apparatus 17, which relies on conduction to impart thermal energy to the traveling tow. In fact, it has been discovered that between one-half and two-thirds of the thermal energy used by a conventional calender apparatus 17 is used for evaporating moisture from the towband. For example, it is not uncommon for a commercial calender apparatus to use approximately 1.8 megawatts of thermal power, with over one megawatt of that power being used just to evaporate moisture from the traveling tow. This represents a tremendous amount of wasted energy and excess cost required in conventional processing of synthetic filaments.

In addition to the resulting energy waste and additional cost, the current method of processing synthetic filaments also limits the output capacity of existing filament processing lines because the tow density and traveling speed must be limited to a point in which the tow can be adequately heat set by the existing calender apparatus. It would be advantageous to increase the processing capacity of an existing synthetic processing line by increasing the density of the tow, but in order to evaporate the water from a tow of twice the density, twice the powerflux must be provided into the tow. The energy transfer rate, however, is limited by the tow thermal conductivity and a tow of twice the thickness has a four-fold decrease in conductive transfer rate. The net result would be that a fourfold increase in the number of calender rolls would be required, or a fourfold reduction in productivity would occur.

The above described problem of wasting thermal energy in conventional calendering apparatus exists notwithstanding the known practice of passing wet tow through a pair of squeeze rollers prior to heat setting to mechanically remove some moisture from the tow. These nips or squeeze rollers are usually comprised of one roller having a metal surface and the other corresponding roller having a resilient non-metal surface, such as rubber. It is known, for example, that a squeeze roller apparatus may be positioned at the entry to a conventional calender apparatus, a shown in FIG. 1, wherein the tow 12 passes through a pair of squeeze rollers comprising a conventional metal calender roller 47 and a corresponding resilient roller 18 while entering in the calender apparatus 17. Importantly, it is currently thought in the art that the resiliency of the nip is an important factor in avoiding damage to the filaments, as they have not yet been heat set. Moreover, the nip pressure of conventional squeeze rolls installed prior to heat setting is limited by the nature of the resilient materials and is typically less than a few hundred pounds per linear inch of nip contact. Under these pressures, little fiber deformation occurs but a significant amount of moisture remains in the tow and especially in the interstitial spaces 34 of the tow 12. The typical squeeze rollers are able to reduce the moisture content of the tow from around 25% of the fiber weight to only approximately 15% of the fiber weight before entering the calender apparatus.

Contrary to the prevailing belief among those of skill in the art, it has been discovered that high pressure nip rollers may be used to remove excess water from a tow of synthetic filaments prior to heat setting without causing fiber damage, thereby significantly increasing the thermal efficiency of a calendering apparatus and thereby increasing the production capability of a synthetic filament processing line. It has further been discovered that there is no need to use a resilient roller to protect against filament damage while removing moisture from a synthetic tow prior to heat setting the tow filaments. In other words, both rollers of a high pressure nip roller prior to a calender may have metal surfaces in contact with the synthetic fibrous tow. In fact, nip pressure levels that cause temporary deformation of the cross sectional shape of the filaments may even be used without resulting in permanent filament damage or loss or fiber properties.

With this surprising result, it is now possible to significantly reduce the amount of moisture in a tow that enters the heat setting unit by using hard, high pressure dewatering nip rolls. In new installations, this can reduce the size of the required heat setting unit (e.g., calendering apparatus) and significantly decrease the investment costs. On existing installations, use of hard, high pressure nip rolls prior to heat setting can dramatically increase the processing rate and/or decrease the energy cost of operating the processing line.

Figure 2:
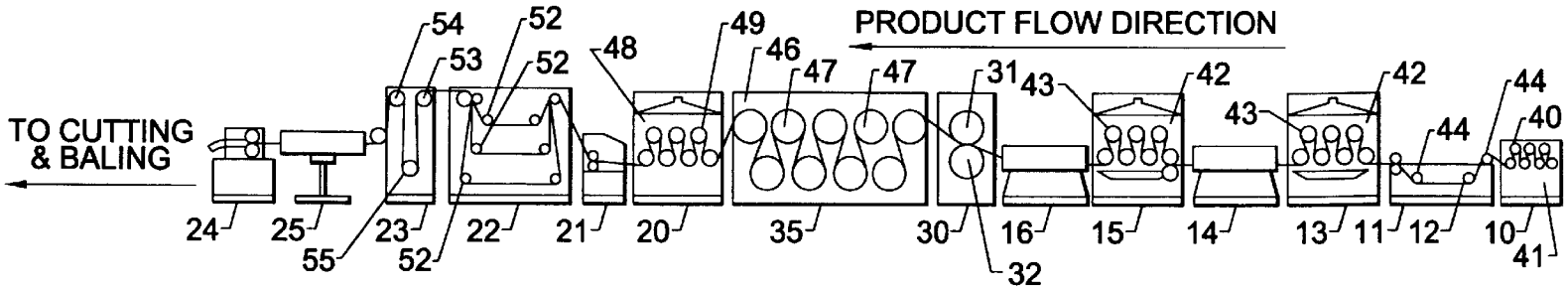
FIG. 2 is a schematic diagram illustrating a system for drawing, heat setting, and crimping a tow of continuous synthetic filaments according to one embodiment of the present invention.

The present invention substantially overcomes the difficulties and disadvantages of conventional synthetic filament processing systems by providing a high pressure dewatering nip roll apparatus in the processing line prior to the heat setting apparatus. Referring to FIG. 2, a processing line for processing a tow of synthetic filaments is illustrated according to the present invention. With the exception of the calendering apparatus 35 and the high pressure nip roll apparatus 30, the processing line of the present invention is essentially identical to the conventional processing line as previously described above. In other words, a processing line according to the present invention may still include a pretensioning stand 10, a vat 11, drawstands 13, 15 and draw chests 14, 16 before the calendering apparatus 35 and may also include the quench stand 20, spray stand 21, stacker stand 22, dancer 23, steam chest 25 and crimper 24 after the calendering apparatus 35. Between the second draw chest 16 and the calender apparatus 35, however, is a high pressure dewatering nip roll apparatus 30 for removing a significant amount of moisture from the tow 12 before the tow is heat set in the calendering apparatus 35.

Figure 3:
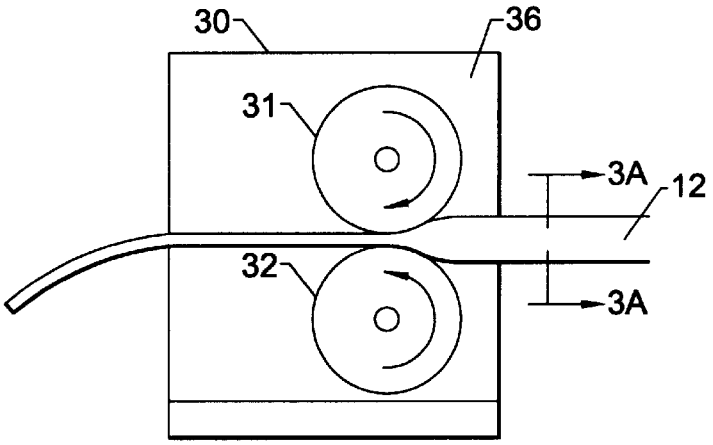
FIG. 3 is a schematic diagram illustrating the dewatering nip roll mechanism of the present invention and a towband advancing therethrough.
Figure 3A:
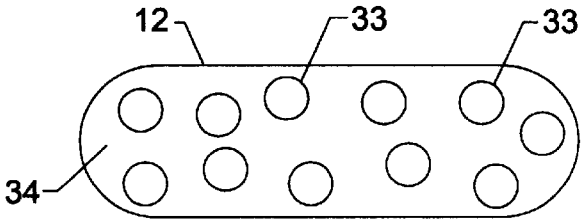
FIG. 3*a* is a cross sectional view of the towband of FIG. 3 taken along the line 3*a*—3*a* in FIG. 3.

FIG. 3 illustrates a high pressure dewatering nip roll apparatus 30 according to the present invention. Specifically, the nip roll apparatus 30 includes a central frame 36, a first nip roller 31, and a second nip roller 32. The nip rollers 31, 32 may be made from any suitable material and are preferably made from metal in order to allow the high pressure nip roller apparatus 30 to exert substantial pressure on the tow 12 as it passes between the nip rollers 31 and 32. It has also been discovered that hard nip roll surfaces may be used to dewater or tow before heat setting without damaging the filaments. In this regard, metal dewatering nip rolls having a Rockwell C hardness of at least about 50, as determined using the test procedures contained in the American Society for Testing and Materials (ASTM) standard E18, may be satisfactorily used without causing fiber damage. It has also been discovered that a pressure of between 500 and 2,000 lbs. per linear inch of nip roll contact may be used to dewater the tow 12 without damaging the filaments 33 in the tow. Use of a high pressure dewatering nip roll apparatus can remove moisture from the tow down to a level of less than 5% of moisture by weight.

It has further been found that high pressures within the high pressure nip roll apparatus 30 and more specifically the nip rollers 31,31 may exert enough pressure on the tow to deform individual filaments, but that such deformation does not adversely affect the strength or properties of the filaments 33. Each nip roll 31,32 should be long enough to accommodate the transverse width of the towband or towbands prior to the calender apparatus, which is often approximately 1 to 1½ meters in transverse width.

In this regard it should be noted that nip pressure and moisture percent in the tow are measured by the following formulas:

$$\%\ \text{moisture} = \frac{\text{wet weight} - \text{dry weight}}{\text{dry weight}} \times 100$$

$$\text{Nip Pressure} = \frac{\text{total force applied by nip rolls}}{\text{transverse width of nip roll contact}}$$

Because the present invention allows for a significant increase in the reduction of moisture from the tow prior to heat setting, a smaller calendering apparatus 35 may be used when using the high pressure dewatering nip roll apparatus of the present invention. This is because less thermal energy is required to heat set the synthetic filaments in the present invention as there is less moisture for the heat setting device to evaporate before elevating the temperature of the tow filaments and therefore less calender rolls are required to heat set a given density of tow. Conversely, the present invention may be used with a conventional calender apparatus 17 in which case higher density tows may be processed than are currently processed using the calender apparatus 17 or a given density of tow may be processed at a higher speed.

The following examples illustrate the significant advantages obtained when using the high pressure dewatering nip roll apparatus of the present invention to dewater a synthetic filament tow prior to heat setting.

EXAMPLE 1

A towband composed of 224,736 filaments (0.95 denier per filament) was prepared by spreading it over a width of 1.5 inches and saturating it with moisture. The towband was then passed between the nips of a pair of rollers while being maintained under tension. The upper roller was a 9.75 inch steel roll and the lower roller was an 8 inch diameter rubber roll with a Shore O hardness of 95 as determined by the procedures set forth in the American Society for Testing and Materials (ASTM) standard D2240. The speed of operation was 100 meters per minute. Samples were collected from the downstream side of the nip roll and their residential moisture level was found by weighing the samples before and after drying in a lab oven.

Various levels of nip pressure were employed, ranging from none (open nips) to the maximum recommended by the equipment supplier. The results are shown in the following table:

| cylinder pressure (bar) | nip load (#/in) | % moisture |
|---|---|---|
| 0 | 0 (nip open) | 21.7 |
| 2.5 | 142 | 5.9 |
| 4.5 | 255 | 5.6 |
| 7.5 | 425 | 4.1 |

EXAMPLE 2

A towband similar to Example 1 was prepared and passed between the nips of a pair of high pressure steel rolls at 100m/min. The rolls were 130 mm in diameter and had a Rockwell C hardness of 56–58 as determined by the procedures set forth in the American Society for Testing and Materials (ASTM) standard E18. The residual moisture was as follows:

| cylinder pressure (bar) | nip load (#/in) | % moisture |
|---|---|---|
| 0 | 0 (nip open) | 14.0 |
| 1 | 537 | 4.1 |
| 2 | 1073 | 2.0 |
| 3 | 1610 | 1.2 |

EXAMPLE 3

Example 2 was repeated with the speed increased to 300 m/min, with the following results.

| cylinder pressure (bar) | nip load (#/in) | % moisture |
|---|---|---|
| 0 | 0 (nip open) | 14.0 |
| 1 | 537 | 5.4 |
| 2 | 1073 | 3.3 |
| 3 | 1610 | 1.8 |

Figure 4:
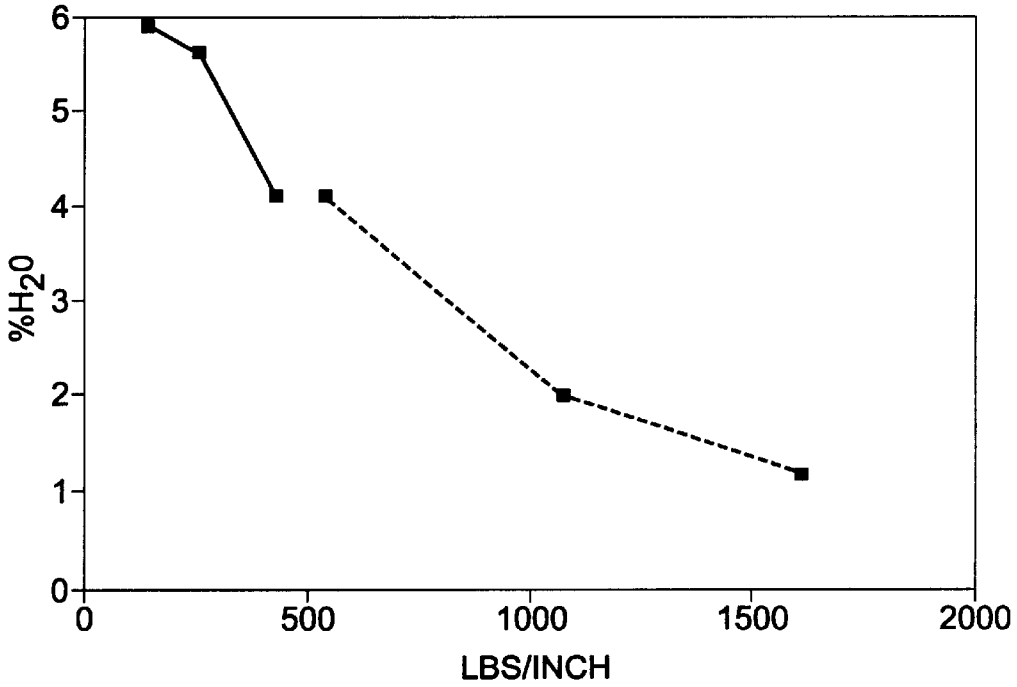
FIG. 4 is a graph illustrating experimental data presented in Examples 1 and 2 on percent moisture achieved using various nip pressures.
Figure 5:
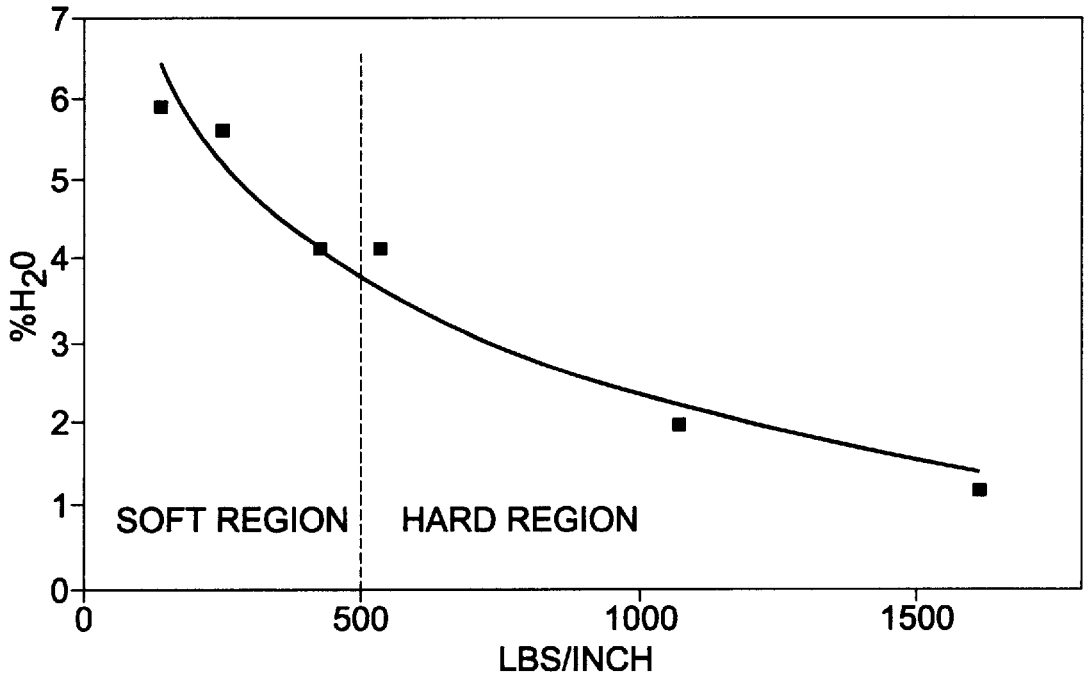
FIG. 5 is a graph similar to FIG. 4 illustrating a log curve obtained by treating the data from Examples 1 and 2 as a single data set.

FIGS. 4 and 5 illustrate the data obtained in Examples 1 and 2 above. In FIG. 4, data obtained in Example 1 using a soft nip roll illustrated using a solid line and data obtained from Example 2 using a pair of high pressure steel rolls is illustrated using dashed lines. In FIG. 5, the data was treated as one data set and fitted to a log curve. While the data indicates that pressure and not nip material appears to be the primary factor governing moisture removal in the high pressure nip apparatus 30, in practical application steel nip rollers are used for higher pressure application, which may be generally thought of as those pressures above 500 lbs. per linear inch. For this reason, FIG. 5 is generally denoted as having a soft region below 500 lbs. per inch in which rubber or other resilient material may be used for the nip roll surface and a hard region above 500 lbs. per inch in which steel nip rollers or other metallic nip rollers are used.

EXAMPLE 4

In addition to the fact that high pressure dewatering nip rollers may be used prior to heat setting without damaging synthetic filaments of a tow, it is also surprisingly been discovered that the uniformity of tow presentation to the nip rollers has little effect on the efficiency and success of the present invention. Specifically, an experimental draw frame was equipped with a set of 1.5 inch wide crimper nips after the draw stands to simulate the use of hard nips prior to heat setting. Wet, drawn tow was presented to the nips and a range of nip pressures were employed for dewatering. Average tow densities measured in thousands of deniers per inch (KDI) were varied by prestacking various number of towbands (from two to four) at the creel. Presentation uniformity was varied from good to poor by deliberately generating thick and thin areas across the 1.5 inch width of the towband.

While it was anticipated that fiber damage would be generated at high nip pressures, especially when the KDI was nonuniform and the thick areas would be bearing the entire nip load, it was surprisingly discovered that such was not the case. Fiber damage was tested by Fafegraph breaks of 30 fils from each towband, chosen from the left edge, center and right edge of the band. Significant levels of damage would result in a reduction in average properties and an increase in the property variability.

The results of this experiment are presented in the table below, where: tenacity (Ten) is presented in units of grams/denier (gpd); elongation to break (Eb) is presented as a percent; the coefficient of variation of elongation to break (EbCV), which measures the variability of breaking elongation among various filaments, is determined by dividing the standard derivation of Eb by the average Eb; and toughness/strength ($TxE^{-3}$) is used as a measure of filament damage. If a filament is damaged, then $TxE-^{-3}$ would be expected to decrease.

Nip Roll Damage Tests: Uniform vs Nonuniform KDI

| NipLoad (bar) | Ave KDI | Uniformity | Ten (gpd) | Eb (%) | Eb-CV (%) | TenCV | $TxE^3$ |
|---|---|---|---|---|---|---|---|
| 0 | 75 | good | 5.59 | 31.90 | 27.50 | 9.10 | 15.80 |
| 1 | 75 | good | 5.42 | 29.00 | 20.10 | 6.70 | 14.88 |
| 2 | 75 | good | 5.41 | 28.50 | 22.30 | 8.60 | 14.78 |
| 3 | 75 | good | 5.55 | 31.40 | 24.90 | 7.80 | 15.61 |
| 4 | 75 | good | 5.36 | 31.60 | 25.80 | 9.50 | 15.10 |
| 5 | 75 | good | 5.45 | 33.50 | 21.90 | 13.20 | 15.63 |
| 0 | 75 | bad | 5.27 | 21.30 | 31.20 | 17.80 | 13.19 |
| 1 | 75 | bad | 5.59 | 29.70 | 16.70 | 8.70 | 15.46 |
| 2 | 75 | bad | 5.46 | 28.50 | 19.70 | 8.80 | 14.92 |
| 3 | 75 | bad | 5.56 | 26.90 | 19.30 | 7.90 | 14.93 |
| 4 | 75 | bad | 5.41 | 24.90 | 36.20 | 13.00 | 14.19 |
| 5 | 75 | bad | 5.56 | 34.80 | 23.70 | 9.60 | 16.13 |
| 0 | 150 | good | 5.68 | 31.80 | 21.80 | 8.40 | 16.04 |
| 1 | 150 | good | 5.25 | 31.40 | 25.90 | 11.90 | 14.77 |
| 2 | 150 | good | 5.56 | 29.60 | 31.70 | 12.70 | 15.36 |
| 3 | 150 | good | 5.63 | 32.10 | 24.70 | 9.20 | 15.94 |
| 4 | 150 | good | 5.23 | 36.40 | 39.60 | 18.50 | 15.38 |
| 5 | 150 | good | 5.58 | 35.00 | 21.30 | 8.50 | 16.21 |
| 0 | 150 | bad | 5.59 | 37.20 | 23.70 | 9.10 | 16.54 |
| 1 | 150 | bad | 5.73 | 35.40 | 21.10 | 6.60 | 16.71 |
| 2 | 150 | bad | 5.59 | 33.40 | 23.60 | 7.60 | 16.02 |
| 3 | 150 | bad | 5.63 | 33.00 | | | 16.07 |
| 4 | 150 | bad | 5.47 | 31.40 | 26.60 | 10.40 | 15.38 |
| 5 | 150 | bad | 5.90 | 34.70 | 17.60 | 5.80 | 17.24 |

The nip loading was such that one bar produces a nip pressure of about 540 pounds ear inch of nip roller transverse width. At the maximum pressure of five bar, the nip are greater than those typically encountered during crimping.

Figure 6:
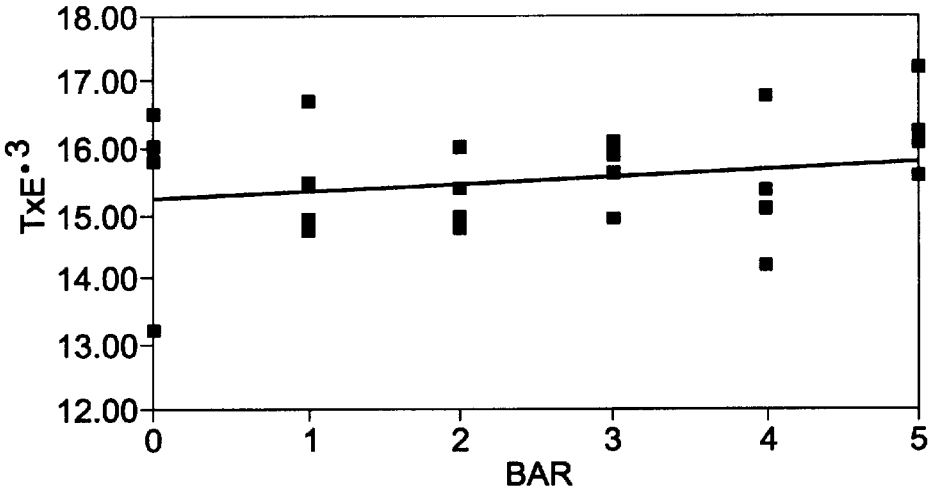
FIG. 6 is a graph illustrating experimental data presented in Example 4 on filament toughness/strength for various nip loads.
Figure 7:
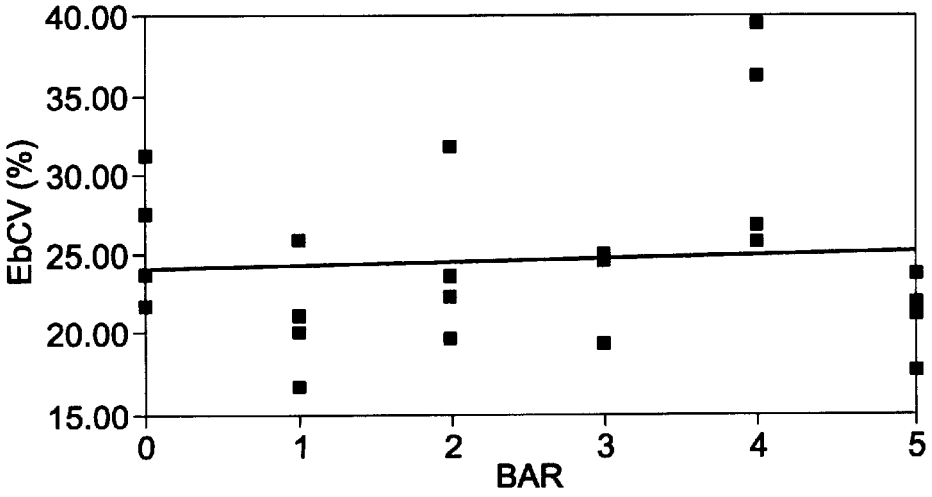
FIG. 7 is a graph illustrating experimental data presented in Example 4 on the coefficient of variation of the elongation to break property for various nip loads.

The results of Example 4 are illustrated in FIGS. 6–10. If there was damage associated with high nip pressures, then one should expect to see a trend toward lower properties and higher CV as nip pressure increased from zero to the maximum pressure. As seen in FIGS. 6 and 7, no such trend existed. FIG. 6 illustrates the data obtained when $TxE^{-3}$ is plotted against nip load, where $R^2$=0.0437. FIG. 7 illustrates EbCV plotted against nip load, where $R^2$=0.0049.

Neither the average toughness or the elongation variability displays a statistically significant trend. This is also true for the average tenacity, elongation, and CV of tenacity. It thus appears that nip pressure is not a factor, in this pressure range.

Figure 8:
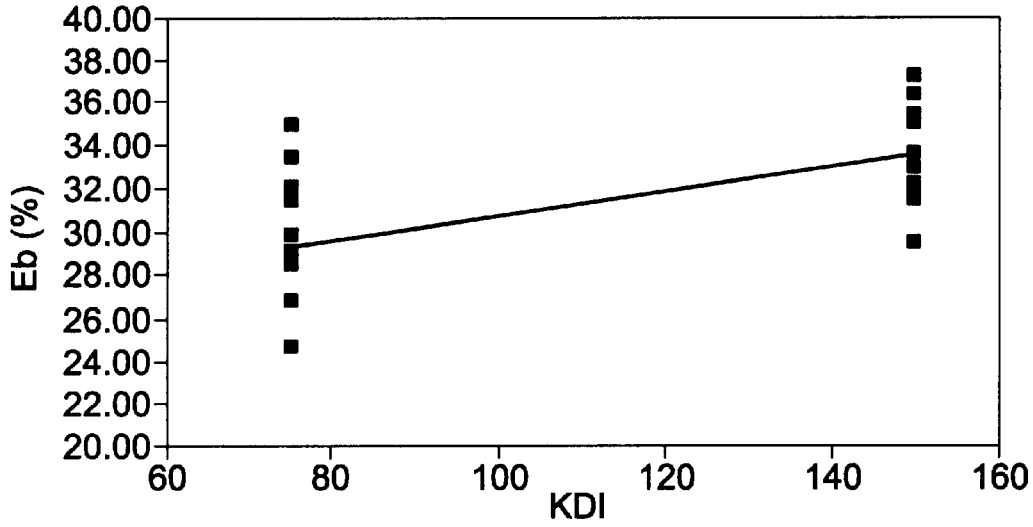
FIG. 8 is a graph illustrating experimental data presented in Example 4 on elongation to break for various average tow densities.
Figure 9:
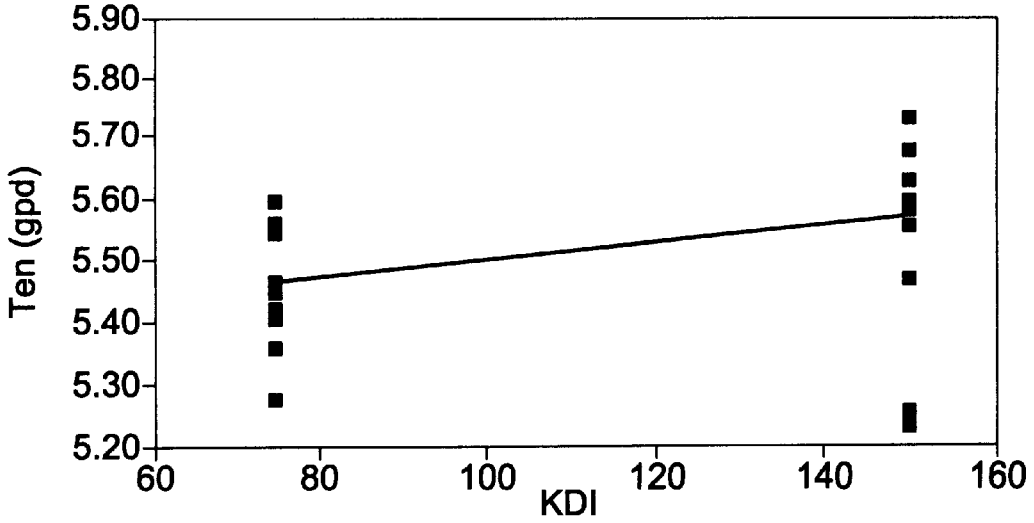
FIG. 9 is a graph illustrating experimental data presented in Example 4 on filament tenacity for various average tow densities.

FIGS. 8 and 9 illustrate the surprising result obtained when the tested properties are plotted against average KDI. FIG. 8 illustrates elongation to break (Eb) plotted against KDI, where $R^2$=0.3279 and p<1%. FIG. 9 illustrates tenacity plotted against KDI, where $R^2$=0.1094 and p=10%. Both of these results are statistically significant, at the 99th percentile and 90th percentile confidence levels respectively. A higher KDI is associated with stronger fibers (higher tenacity and higher elongation). This does not appear to be associated with anything happening within the nip rolls since they were previously shown to have no effect on the tested properties.

Figure 10:
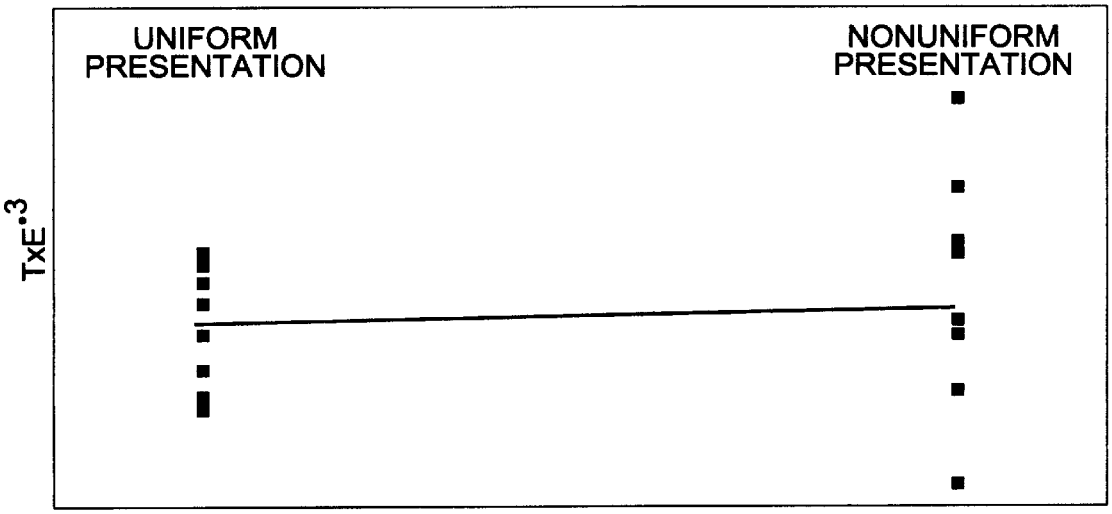
FIG. 10 is a graph illustrating experimental data presented in Example 4 on filament toughness/strength for uniform and nonuniform tow presentations to the nip.

FIG. 10 illustrates the surprising and unexpected results that occurred when the $TxE^{-3}$ data was plotted against towband uniformity (uniform or nonuniform), in which $R^2$=0.0044.

Although no significant change in average toughness occurs as the uniformity becomes worse, there is clearly a larger range in properties from sample to sample. With nonuniform KDI, there are some samples with better properties, and some with worse. This is interpreted as a KDI effect. The portions of the towband that are higher in KDI produce stronger fibers, while the thinner portions produce fibers that are less strong.

It is not possible to infer the reason for the KDI effect from the data obtained. It does not appear to be associated with the nip rolls themselves, but may perhaps be associated with the drawing process. It is possible that a thicker KDI exposes a smaller fraction of fibers to the roll surface, thus reducing the sliding damage therefrom. The actual cause, however, remains unknown.

In summary, the above data shows no evidence of fiber damage as a result of using hard nip rolls at high nip pressures to remove moisture from a towband before heat setting the filaments in the tow. Even when the towband was deliberately misaligned and nonuniform in thickness, fiber properties were unaffected. Surprisingly, a high KDI drawing process (150 KDI) yielded better fiber properties than did a 75 KDI process and this result was consistent over the entire range of nip pressures, whether or not the towband was misaligned. This result, however, is not yet understood.

As demonstrated by the above discussion, the present invention advantageously allows for a substantial increase in thermal efficiency of existing calender apparatus by mechanically removing moisture from a tow of synthetic filaments prior to heat setting using high-pressure dewatering nip rollers. The present invention also allows for increased processing capability of existing synthetic tow processing lines. Moreover, it has been discovered that, contrary to the prevailing wisdom in the art, high-pressure hard nip rollers may be used on synthetic filaments prior to heat setting without damaging the filaments. Advantageously, then, the present invention achieves a substantial reduction in operating costs associated with existing heat setting apparatus and may also allow for the use of smaller more efficient calendering apparatus in the processing of synthetic filaments.

It will readily be understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to its preferred embodiment, it is to be understood that this disclosure is only illustrative and exemplary of the present invention and is made merely for the purpose of providing a full and enabling disclosure of the invention. The foregoing disclosure is not intended to be construed to limit the present invention or otherwise to exclude any such other embodiments, adaptations, variations, modifications or equivalent arrangements; the present invention being limited only by the claims appended hereto and the equivalents thereof. Although specific terms are employed herein, they are used in a generic and descriptive sense only and not for the purpose of limitation.

That which is claimed is:

1. A method of treating a traveling tow of synthetic filaments comprised of molecular chains which are generally unoriented or are only partially oriented with respect to one another, the method comprising the sequential steps of:

drawing the tow in a moisture wetted state to orient generally lengthwise the molecule chains in the synthetic filaments;

then dewetting the tow to remove moisture therefrom by conveying the wetted drawn tow between a pair of nip rolls exerting a pressure of at least about 500 pounds of force per linear inch of axial nip contact between the nip rolls; and then heat setting the dewetted drawn tow to crystallize substantially the oriented molecular chains in the synthetic filaments, the amount of energy required to heat set the tow being reduced in relation to the amount of moisture removed by the dewetting of the tow.

2. A method of treating a traveling tow of synthetic filaments as defined in claim 1 wherein the dewetting of the tow comprises removing moisture from the tow such that the moisture content of the tow is less than 10%.

3. A method of treating a traveling tow of synthetic filaments as defined in claim 2 wherein the dewetting of the tow comprises removing moisture from the tow such that the moisture content of the tow is less than 5%.

4. A method of treating a traveling tow of synthetic filaments as defined in claim 1 wherein the heat setting of the tow comprises conveying the drawn dewetted tow about a plurality of heated calender rolls.

5. A method of treating a traveling tow of synthetic filaments as defined in claim 4 wherein the heat setting of the tow comprises heating the plurality of calender rolls to a temperature of at least 150° C.

6. A method of treating a traveling tow of synthetic filaments as defined in claim 1 wherein the dewetting of the tow comprises exerting a pressure between the nip rolls of between about 500 and about 2000 pounds of force per linear inch of axial nip roll contact.

7. A method of treating a traveling tow of synthetic filaments as defined in claim 6 wherein the dewetting of the tow comprises exerting a pressure between the nip rolls of about 1000 pounds of force per linear inch of axial nip roll contact.

8. A method of treating a traveling tow of synthetic filaments as defined in claim 7 wherein the dewetting of the tow comprises exerting a pressure between the nip rolls of about 1500 pounds of force per linear inch of axial nip roll contact.

9. A method of treating a traveling tow of synthetic filaments as defined in claim 1 wherein the dewetting of the tow further comprises providing each of the nip rolls with a peripheral surface of metal contacting the tow therebetween.

10. A method of treating a traveling tow of synthetic filaments as defined in claim 9 wherein the dewetting of the tow further comprises providing the peripheral metal surface of each nip roll with a Rockwell C hardness of at least about 50, as determined using the test procedures contained in the American Society for Testing and Materials (ASTM) standard E18.

11. A method of treating a traveling tow of synthetic filaments as defined in claim 1 wherein the tow comprises polyester filaments and wherein the drawing of the tow comprises using a water-containing composition and the heat setting of the tow comprises heating the tow to a temperature greater than the boiling point of water to evaporate the water from the tow.

12. An apparatus for treating a traveling tow of synthetic filaments comprised of molecular chains which are generally unoriented or only partially oriented with respect to one another, the apparatus comprising:

a drawing station comprising means for applying an elongation force lengthwise to the traveling tow in a moisture wetted state to orient generally lengthwise the molecular chains in the synthetic filaments;

a tow dewetting station comprising a pair of nip rolls for travel of the tow therebetween for removing moisture therefrom and means for exerting a dewetting pressure between the nip rolls of at least about 500 pounds of force per linear inch of axial nip roll contact between the nip rolls;

a calendering station comprising a plurality of calender rolls, each having a heated cylindrical periphery and arranged relative to one another for travel of the tow successively in at least partial peripheral engagement with the respective peripheries of the calender rolls for heat setting of the tow; and a means for conveying the tow in sequence first to the drawing station, then to the dewetting station for travel between the nip rolls thereof and then to the calendering station for travel about the calender rolls, wherein the amount of energy required of the calender station to heat set the tow is reduced in relation to the amount of moisture removed by the dewetting station.

13. An apparatus for treating a traveling tow of synthetic filaments as defined in claim 12 wherein at least one nip roll of said pair of nip rolls has a peripheral roll surface of metal in contact with the traveling tow.

14. An apparatus for treating a traveling tow of synthetic filaments as defined in claim 13 wherein both nip rolls of said pair of nip rolls have a peripheral surface of metal in contact with the traveling tow.

15. An apparatus for treating a traveling tow of synthetic filaments as defined in claim 13 wherein the metal peripheral roll surface in contact with the traveling tow has a Rockwell C hardness of at least about 50, as determined using the test procedures contained in the American Society for Testing and Materials (ASTM) standard E18.

16. An apparatus for treating a traveling tow of synthetic filaments as defined in claim 12 wherein the cylindrical periphery of each roll in said a calendering apparatus is heated to a temperature of at least 150° C.

17. An apparatus for treating a traveling tow of synthetic filaments as defined in claim 12 wherein the pair of nip rolls exert between about 500 and about 2000 pounds of force per linear inch of axial nip roll contact.

18. An apparatus for treating a traveling tow of synthetic filaments as defined in claim 17 wherein the pair of nip rolls exert about 1000 pounds of force per linear inch of axial nip roll contact.

19. An apparatus for treating a traveling tow of synthetic filaments as defined in claim 17 wherein the pair of nip rolls exert about 1500 pounds of force per linear inch of axial nip roll contact.

* * * * *